United States Patent [19]

Everett

[11] Patent Number: 4,745,874

[45] Date of Patent: May 24, 1988

[54] KAYAK INTERNAL SUPPORT SYSTEMS

[76] Inventor: Russell H. Everett, 281 Succotash Rd., Wakefield, R.I. 02879

[21] Appl. No.: 11,546

[22] Filed: Feb. 6, 1987

[51] Int. Cl.[4] ..... B63B 35/72

[52] U.S. Cl. ..... 114/347; 114/355

[58] Field of Search ..... 52/726; 114/352, 353, 114/347, 355, 356, 357; 403/268, 300, 345, 353, 354, 375, 383, 361; 244/124

[56] References Cited

U.S. PATENT DOCUMENTS

| | | | |
|---|---|---|---|
| 4,227,272 | 10/1980 | Masters | 9/6 R |
| 4,229,850 | 10/1980 | Arcouette | 9/1.4 |
| 4,407,216 | 10/1983 | Masters | 114/347 |
| 4,478,167 | 10/1984 | Hart | 114/343 |
| 4,480,579 | 11/1984 | Masters | 114/347 |

*Primary Examiner*—Joseph F. Peters, Jr.
*Assistant Examiner*—Edwin L. Swinehart
*Attorney, Agent, or Firm*—Maurice M. Klee

[57] ABSTRACT

An internal support system for the cockpit portion of a kayak is provided which comprises rigid bow and stern plates, which are fastened to the kayak's bow and stern decks, respectively, and extend from those decks to the kayak's bottom hull, and a stiffening connecting plate which rigidly connects the bow and stern plates to one another. The connecting plate and the bow and stern plates define a concave contour in the region of the cockpit opening to receive the kayak's seat and to allow the kayaker to enter and exit the kayak. The support system makes the cockpit area of the kayak dramatically less likely to collapse if the kayak becomes pinned on a rock in the rapids of a river. It also allows the kayaker to readily exit the kayak during an emergency. To provide support throughout the length of the kayak, the cockpit support system can be connected to foam walls located in the bow and stern portions of the boat.

13 Claims, 2 Drawing Sheets

KAYAK INTERNAL SUPPORT SYSTEMS

BACKGROUND OF THE INVENTION

1. Field of the Invention

This invention relates to kayaks and, in particular, to improved internal support systems for kayaks.

2. Description of the Prior Art

For at least the past 20 years, efforts have been made to provide an internal support system which will prevent kayaks from collapsing when they become broached and pinned on a rock or other obstacle in the rapids of a river. Such an internal support system and, in particular, an internal support system for the bow and cockpit portions of the boat, is of utmost importance since if the kayak collapses, the kayaker's legs can be pinned in the boat with such force that the kayaker cannot exit the boat and reach safety. Moreover, there is a real risk of drowning if the kayaker becomes pinned with his head below water, as can easily be the case. Examples of the types of internal support systems which have been considered can be found in U.S. Pat. Nos. 4,227,272, 4,229,850 and 4,407,216.

Some of the earliest efforts at solving the problem of kayak collapse involved the use of vinyl flotation air bags placed in the bow and stern of fiberglass kayaks. Unfortunately, this simple approach did not provide significant protection against collapse. Somewhat later, vertical styrofoam and later ethafoam walls (also referred to as pillars) were placed in the bow and stern of the boat and held in place with flotation bags placed on opposite sides of the walls. Initially, 2 inch thick walls were used, and subsequently, 3 inch thick ones.

Although the wall system approach did significantly reduce the probability of the collapse of the bow and stern portions of the kayak, there still were problems. For example, the walls often did not stay in place and thus became ineffective in providing protection for the kayaker. Even more importantly, the cockpit area of the kayak was essentially unprotected and thus became the most likely place where the kayak would collapse. Significantly, it is the cockpit area, and in particular, the bow portion of the cockpit area between the kayaker's trunk and his knees, where protection is most needed since, as discussed above, if the kayak collapses in this area, the kayaker can be pinned in his boat.

The next improvement, which represents the present state of the art, involved interlocking the wall system with the kayak's seat. Originally introduced by Perception, Inc., Liberty, S.C., as 2 inch thick plastic walls in an all plastic kayak, the system was later modified by Perception, Inc., and other manufacturers through the use of 3–5 inch thick minicell foam. Although interlocking the walls and the seat reduced the probability of the walls shifting during use, problems still remained. In the first place, with the bow wall beginning right at the end of the seat, there was not enough room left in the kayak for the kayaker to pull his knees up to his chest while still seated to exit the kayak during an emergency. Moreover, the cockpit area of the kayak still was basically unprotected and thus the most likely place for collapse to occur.

SUMMARY OF THE INVENTION

In view of the foregoing state of the art, it is an object of the present invention to provide improved internal support systems for kayaks. In particular, it is an object of the invention to provide internal support systems for kayaks which provide protection from collapse along the full length of the kayak, including the cockpit area. Even more specifically, it is an object of the invention to provide internal support systems wherein the probability of collapse is dramatically lowered in the area of the cockpit. It is an additional object of the invention to provide internal support systems of the foregoing types wherein the support system leaves enough room within the kayak for the kayaker to pull his knees up to his chest while still seated to exit the kayak during an emergency.

To achieve the foregoing and other objects, the invention provides an internal support system for the cockpit portion of a kayak which comprises:

(a) a vertically-oriented, rigid bow plate, which is located along the midplane of the kayak and extends between the kayak's bow deck and its bottom hull;

(b) a vertically-oriented, rigid stern plate which is also located along the midplane of the kayak and which extends between the kayak's stern deck and its bottom hull; and (c) means for rigidly connecting the bow plate to the stern plate.

The bow plate and stern plate include fastening means for connecting the respective plates to the bow and stern decks of the kayak. The means for rigidity connecting the bow and stern plates is of sufficient length so that the point of contact of the bow plate's fastening means and the bow deck is forward of the cockpit opening and the point of contact of the stern plate's fastening means and the stern deck is rearward of the cockpit opening. The bow plate, stern plate and rigid connecting means define a concave contour in the region of the cockpit opening to receive the kayak's seat and to allow the kayaker to enter and exit the kayak. By means of this structure, the goals of making the cockpit portion of the kayak dramatically less likely to collapse while at the same time allowing the kayaker to easily exit the kayak during an emergency are achieved.

In addition to the foregoing, in accordance with other aspects of the invention, the cockpit support structure described above is integrated with foam, wall-type support structures in the bow and stern of the kayak. In this way, support throughout the length of the kayak is achieved. In accordance with these aspects of the invention, the wall support structure for the bow portion of the kayak is located sufficiently far forward in the bow of the boat so as not to interfere with the kayaker bringing his knees to his chest while still seated when exiting the kayak.

The accompanying drawings, which are incorporated in and constitute part of the specification, illustrate the preferred embodiments of the invention, and together with the description, serve to explain the principles of the invention.

DESCRIPTION OF THE PREFERRED EMBODIMENTS

Figure 6:
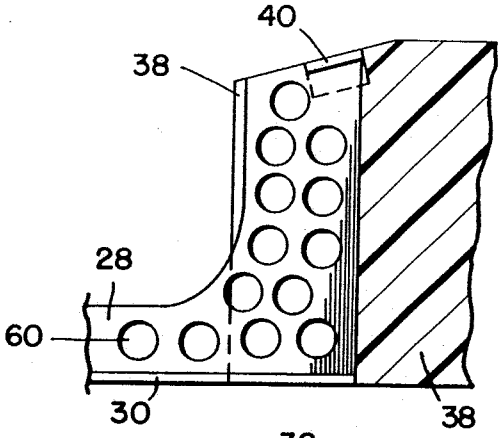
FIG. 6 is a cross-sectional view along lines 6—6 in FIG. 5.
Figure 7:
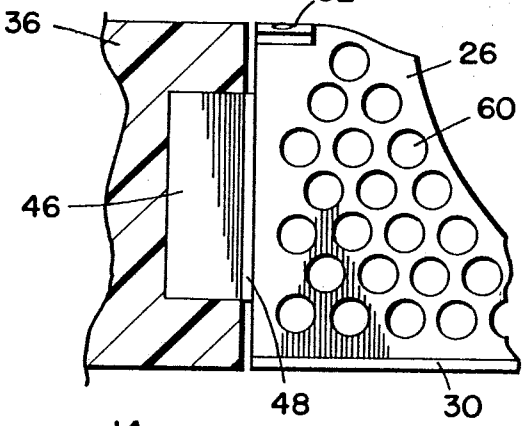
FIG. 7 is a cross-sectional view along lines 7—7 in FIG. 4.
Figure 1:
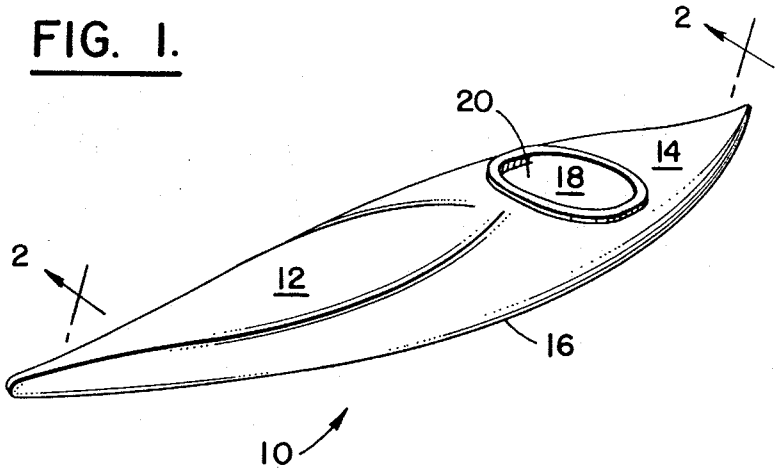
FIG. 1 is a perspective view of a kayak having disposed therewithin the internal support system of the present invention.
Figure 2:
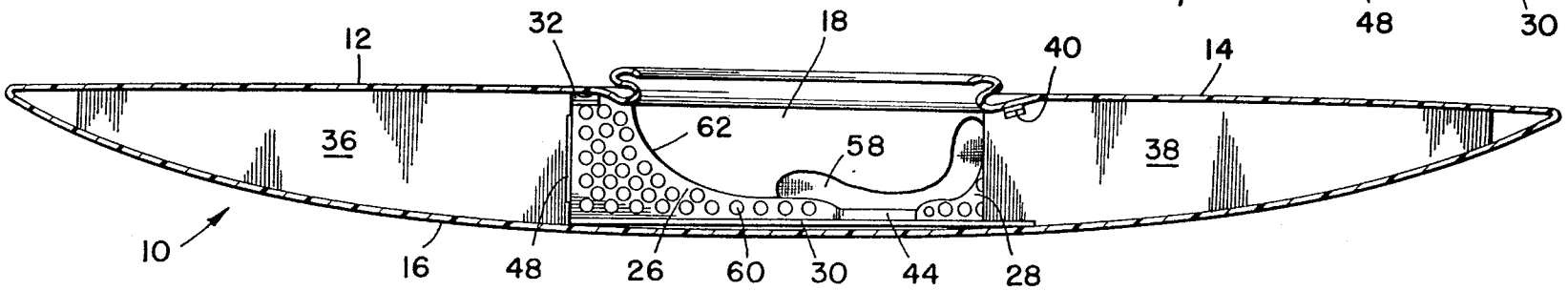
FIG. 2 is a cross-sectional view along the midplane of the kayak (lines 2—2 in FIG. 1) showing the relationship between the structure of the support system and the structure of the kayak.

With reference now to the drawings, wherein like reference characters designate like or corresponding parts throughout the several views, there is shown in FIG. 1 a kayak 10 having a bow deck 12, a stern deck 14, a bottom hull 16, a cockpit 18, and a cockpit opening 20.

Figure 3:
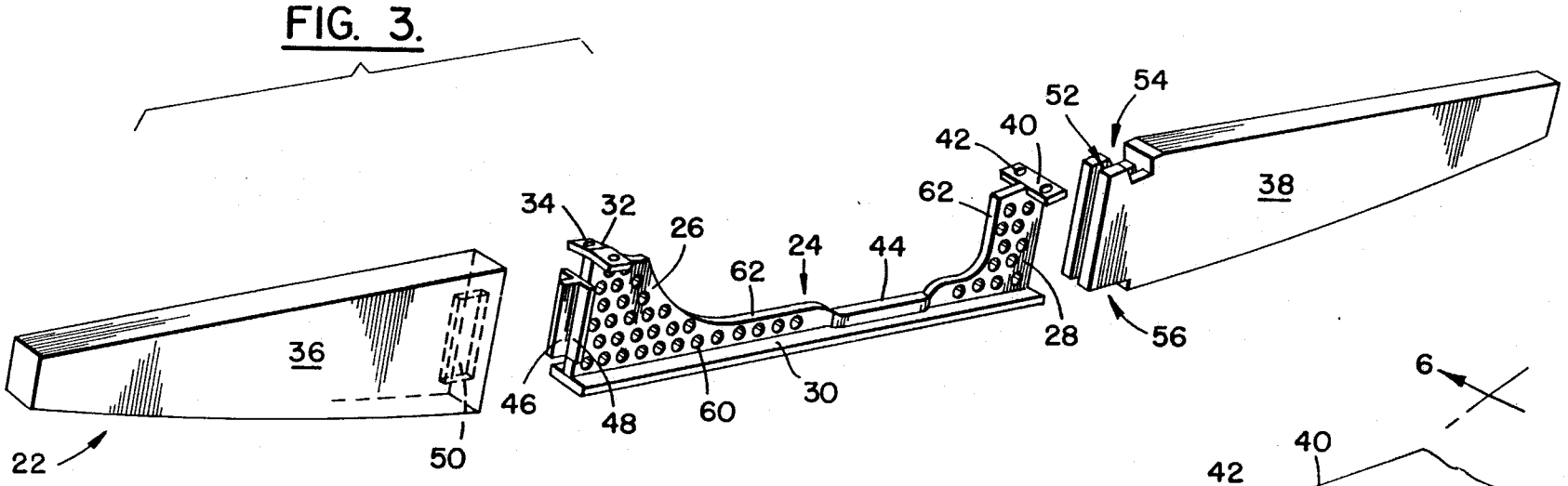
FIG. 3 is an exploded, perspective view of the support system.
Figure 5:
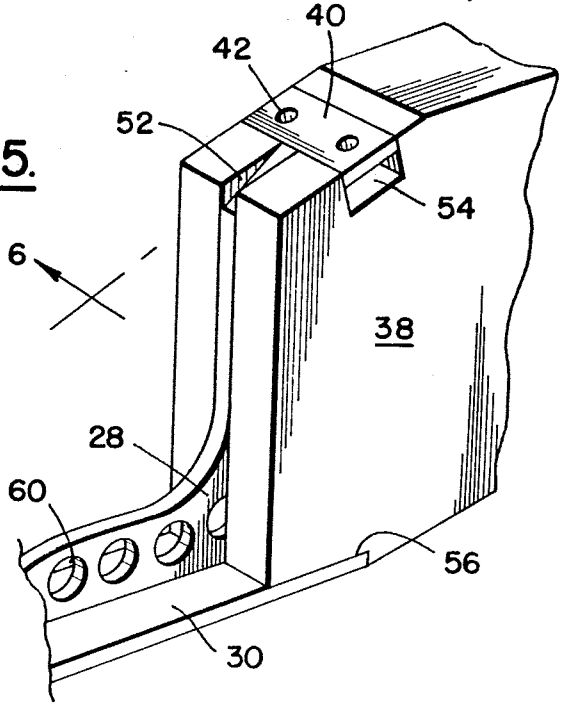
FIG. 5 is a detailed view of a preferred construction for attaching the stern plate portion of the support system to a stern wall member.
Figure 4:
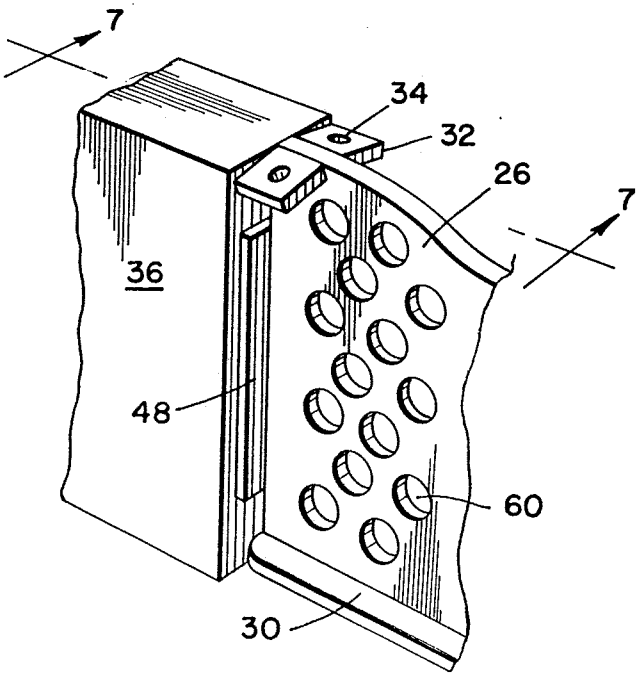
FIG. 4 is a detailed view of a preferred construction for attaching the bow plate portion of the support system to a bow wall member.

As can best be seen in FIG. 3, the overall support system 22 includes a cockpit support portion 24, a bow wall member 36, and a stern wall member 38. Cockpit support portion 24 includes bow and stern plates 26 and 28, respectively. Bow plate 26 includes fastening plate 32 at its upper, forward portion for fastening the bow plate to bow deck 12 as, for example, by means of bolts which pass through the bow deck and through holes 34 formed in plate 32. Similarly, stern plate 28 includes fastening plate 40 at its upper, rearward portion for fastening the stern plate to stern deck 14. Again, the fastening can be by means of bolts which, in this case, pass through the stern deck and through holes 42 in fastening plate 40.

Connecting plate 30 connects bow plate 26 and stern plate 28. This plate extends over the full length of cockpit 18 and is sized so that fastening plate 32 is located in front of cockpit opening 20 and fastening plate 40 is located behind the opening. Connecting plate 30 preferably extends transversely from plates 26 and 28 so as distribute stresses over a larger area of bottom hull 16 of kayak 10.

Connecting plate 30 includes stiffening bar 44 to provide even greater strength and rigidity to the supporting structure in the cockpit area. The upper srufaces of bow plate 26, stern plate 28 and stiffening bar 44 define a concave contour 62. When the supporting system is assembled into the kayak, this contour lies under cockpit opening 20 and serves to receive seat 58 and to allow the kayaker to easily enter and exit the kayak. The bottom of seat 58 (not shown) can either be separated from the support structure or can contact it or be connected to it, as desired.

Wall members 36 and 38 are similar to the wall members used in prior art support system. Significantly, however, wall member 36 does not extend as far aftward as prior art bow wall members. This permits a kayaker to bring his knees to his chest while still seated when exiting the kayak.

Bow wall member 36 is held in place along the midplane of the kayak by means of plates 46 and 48, which lie along and transverse to the midplane of the kayak, respectively. Plate 46 is received in slot 50 formed in wall member 36; plate 48 engages the aft portion of the wall member. In this way, the wall member is restrained from both twisting out of the midplane of the boat and sliding backward into cockpit 18.

Stern wall member 38 is held in place by means of slots 52 and 54 which receive respectively stern plate 28 and fastening plate 40. Stern wall member 38 also includes cutout 56 for receiving connecting plate 30 as the wall member is mated with the stern and fastening plates.

The components making up cockpit support portion 24 of the overall support system are preferably made of aluminum so as to provide high strength with low weight. For example, it has been found suitable to use $\frac{3}{8}$" thick aluminum stock for bow plate 26, $\frac{1}{4}$" stock for stern plate 28 and connecting plate 30, and $\frac{1}{2}$" stock for stiffening bar 44. As shown in the figures, it has also been found preferable to perforate the bow and stern plates, as shown at 60, to further reduce the weight of the supporting structure. The aluminum components making up the cockpit support portion can be rigidly attached to one another by various means, such as, by welding. Other rigid materials, such as, reinforced plastic materials, graphite composite materials, and the like, can be used to form the support structure.

Wall members 36 and 38 can be made of a variety of materials, the preferred ones being cellular, polymeric materials, such as, the minicell foams used to construct prior art wall support systems. Wall members having a thickness of approximately three inches are preferred, although thicker and thinner wall members can be used if desired.

The components of the support structure of the invention can be installed in kayak 10 in various ways, the simplest and preferred way being to first place bow wall 36 and stern wall 38 in the bow and stern of the boat, respectively, and then place the cockpit support system in the boat, aft end first, with stern wall 38 and stern plate 28 being mated as the cockpit support system is installed. The bow wall 36 is then mated with plates 46 and 48.

To prevent excessive wear at the points of contact between the rigid portions of the support system and bottom hull 16 of the kayak, a protective material, such as a water resistant tape, can be applied along the midline of the bottom inside of the kayak prior to installation of the support system. Similarly, protective tape can be applied to the outside of the kayak along the midline to prevent wear due to contact with rocks and other obstacles encountered during kayaking. Although the support structure of the invention can be used with any kayak, it is preferred to employ it with kayak's having relatively large cockpit openings, such as, the T-Slalom or Taifun kayak, manufactured by Prijon, (West Germany), to further facilitate exiting of the kayak during an emergency.

Although specific embodiments of the invention have been described and illustrated, it is to be understood that modifications can be made without departing from the invention's spirit and scope. For example, a variety of structures other than those shown can be used for contacting wall members 36 and 38 to plates 26 and 28, such as, C-shaped members which are attached to the plates and contact the outer surfaces of the wall members. Similarly, other means for fastening plates 26 and 28 to the kayak's decks, beside those shown, can be used in practicing the invention. Along these same lines, contour 62 can have a variety of configurations other than the one shown, provided that the contour leaves sufficient room in the cockpit for the kayaker to easily enter and exit the kayak.

What is claimed is:

1. Apparatus for internally supporting the cockpit portion of a kayak, said kayak having a seat, a bottom hull, a bow deck, and a stern deck, comprising:

(a) a rigid bow plate extending between the bow deck and the bottom hull along the midplane of the kayak, at least a portion of the plate forming a direct vertical connection between the bow deck and the bottom hull, said portion being adjacent to the kayak's cockpit, the upper portion of the plate including means for fastening the plate to the bow deck, said means comprising a first fastening plate which is rigidly connected to the bow plate and which transversely extends beyond that plate along the inside surface of the bow deck;

(b) a rigid stern plate extending between the stern deck and the bottom hull along the midplane of the kayak, at least a portion of the plate forming a direct vertical connection between the stern deck and the bottom hull, said portion being adjacent to the kayak's cockpit, the upper portion of the plate including means for fastening the plate to the stern deck, said means comprising a second fastening plate which is rigidly connected to the stern plate and which transversely extends beyond that plate along the inside surface of the stern deck; and (c) means for rigidly connecting the bow plate to the stern plate, said means extending along the midline of the kayak's bottom hull and being of a length such that the point of contact of the bow plate fastening means and the bow deck is forward of the cockpit opening and the point of contact of the stern plate fastening means and the stern deck is rearward of the cockpit opening, said means comprising an elongated plate which is rigidly connected to the bow and stern plates along their bottom edges and transversely extends beyond those plates along the bottom of the kayak;

the bow plate, stern plate and connecting means defining a concave contour in the region of the cockpit opening to receive the kayak's seat and to allow the kayaker to enter and exit the kayak, the first fastening plate, the bow plate, and the elongated plate forming a first rigid supporting structure having the general shape of an I-beam between the bow deck and the bottom hull, and the second fastening plate, the stern plate, and the elongated plate forming a second rigid supporting structure having the general shape of an I-beam between the stern deck and the bottom hull.

2. The apparatus of claim 1 wherein the bow of the kayak further includes a wall member extending between the bow deck and the bottom hull along the midplane of the kayak and the apparatus further includes means associated with the bow plate for retaining the wall member in said midplane.

3. The apparatus of claim 2 wherein the retaining means includes a first plate extending along the midplane of the kayak which engages a verticallyoriented slot formed in the wall member and a second plate transverse to the midplane which engages the rearward edge of the wall member.

4. The apparatus of claim 1 wherein the stern of the kayak further includes a wall member extending between the stern deck and the bottom hull along the midplane of the kayak and the apparatus further includes means associated with the stern plate for retaining the wall member in said midplane.

5. The apparatus of claim 1 wherein the bow plate has a thickness which is sufficiently small to permit the kayaker to bring his knees to his chest while still seated when exiting the kayak.

6. The apparatus of claim 1 wherein the bow plate, the stern plate, and the connecting means are made of aluminum.

7. The apparatus of claim 6 wherein the bow plate and the stern plate are made of perforated aluminum.

8. Apparatus for internally supporting a kayak, said kayak having a cockpit, a seat within the cockpit, a bottom hull, a bow deck, and a stern deck, comprising:

(a) a bow wall member extending between the bow deck and the bottom hull along the midplane of the kayak;

(b) a rigid bow plate extending between the bow deck and the bottom hull along the midplane of the kayak, at least a portion of the plate forming a direct vertical connection between the bow deck and the bottom hull, said portion being adjacent to the kayak's cockpit, the upper portion of the plate including means for fastening the plate to the bow deck, said means comprising a first fastening plate which is rigidly connected to the bow plate and which transversely extends beyond that plate along the inside surface of the bow deck;

(c) first means associated with the bow wall member and the bow plate for connecting the rearward portion of the wall member to the forward portion of the plate and for retaining the wall member in said midplane;

(d) a rigid stern plate extending between the stern deck and the bottom hull along the midplane of the kayak, at least a portion of the plate forming a direct vertical connection between the stern deck and the bottom hull, said portion being adjacent to the kayak's cockpit, the upper portion of the plate including means for fastening the plate to the stern deck, said means comprising a second fastening plate which is rigidly connected to the stern plate and which transversely extends beyond that plate along the inside surface of the stern deck;

(e) a stern wall member extending between the stern deck and the bottom hull along the midplane of the kayak;

(f) second means associated with the stern wall member and the stern plate for connecting the rearward portion of the plate to the forward portion of the wall member and for retaining the wall member in said midplane; and (g) third means for rigidly connecting the bow plate to the stern plate, said means extending along the midline of the kayak's bottom hull and being of a length such that the point of contact of the bow plate fastening means and the bow deck is forward of the cockpit opening and the point of contact of the stern plate fastening means and the stern deck is rearward of the cockpit opening, said means comprising an elongated plate which is rigidly connected to the bow and stern plates along their bottom edges and transversely extends beyond those plates along the bottom of the kayak, the bow plate, stern plate and third means defining a concave contour in the region of the cockpit opening to receive the kayak's seat and to allow the kayaker to enter and exit the kayak, the first fastening plate, the bow plate, and the elongated plate forming a first rigid supporting structure having the general shape of an I-beam between the bow deck and the bottom hull, and the second fastening plate, the stern plate, and the elongated plate forming a second rigid supporting structure having the general shape of an I-beam between the stern deck and the bottom hull.

9. The apparatus of claim 8 wherein the first means includes a first plate connected to the bow plate and extending along the midplane of the kayak which engages a vertically-oriented slot formed in the bow wall member and a second plate connected to the bow plate and oriented transversely to the midplane which engages the rearward edge of the bow wall member.

10. The apparatus of claim 8 wherein the second means includes a vertically-oriented slot formed in the bow portion of the stern wall member which engages a rearward portion of the stern plate.

11. The apparatus of claim 8 wherein the bow plate is sufficiently thin and the bow wall member is connected to the bow plate at a point sufficiently far forward in the bow of the kayak to permit the kayaker to bring his knees to his chest while still seated when exiting the kayak.

12. The apparatus of claim 8 wherein the bow plate, the stern plate, and the connecting means are made of aluminum.

13. The apparatus of claim 12 wherein the bow plate and the stern plate are made of perforated aluminum.

* * * * *